US007600683B2

(12) United States Patent
Firestone

(10) Patent No.: US 7,600,683 B2
(45) **Date of Patent: *Oct. 13, 2009**

(54) SYSTEM AND METHOD FOR IDENTIFYING VEHICLES AND COLLECTING FEES FOR VEHICLE USES OF LAND-WAYS, SEA-WAYS AND AIR-WAYS

(75) Inventor: Paul A. Firestone, 155 W. 68th St., New York, NY (US) 10023

(73) Assignee: Paul A. Firestone, New York, NY (US)

( * ) Notice: Subject to any disclaimer, the term of this patent is extended or adjusted under 35 U.S.C. 154(b) by 125 days.

This patent is subject to a terminal disclaimer.

(21) Appl. No.: 11/741,439

(22) Filed: Apr. 27, 2007

(65) Prior Publication Data

US 2008/0129548 A1 Jun. 5, 2008

Related U.S. Application Data

(63) Continuation-in-part of application No. 09/635,624, filed on Aug. 10, 2000, now Pat. No. 7,237,715.

(51) Int. Cl.
*G07B 15/02* (2006.01)

(52) U.S. Cl. ..... 235/384; 705/13

(58) Field of Classification Search ..... 235/384; 705/13

See application file for complete search history.

(56) References Cited

U.S. PATENT DOCUMENTS

| | | | | |
|---|---|---|---|---|
| 4,555,618 | A * | 11/1985 | Riskin | 235/384 |
| 5,459,304 | A | 10/1995 | Eisenmann | |
| 7,237,715 | B1 | 7/2007 | Firestone | |
| 7,407,097 | B2 * | 8/2008 | Robinson et al. | 235/384 |
| 2004/0083130 | A1 * | 4/2004 | Posner et al. | 705/13 |
| 2005/0197976 | A1 * | 9/2005 | Tuton et al. | 705/417 |

FOREIGN PATENT DOCUMENTS

KR 1020010028955 A 4/2001

* cited by examiner

*Primary Examiner*—Jamara A Franklin

(57) ABSTRACT

The method implants passive bar-code or active transponder-type signaling devices on every vehicle, including cars, boats and aircrafts. The code is associated with the vehicle's VIN vehicle identification number and with the registered owner/owners of the vehicle and is innutted into a central agency computer with other information such as vehicle title, insurance, driver license information, accident history, vehicular inspection and emissions. Vehicle VIN code scanner/readers are positioned in selected areas in the sky and on the ground near the entry of a transportation pathway and the VIN ID identification code are read by the scanner/readers, and communicated with a date and time and geographical location to the central agency. The user is then charged a relevant fee and a periodic report is issued.

4 Claims, 5 Drawing Sheets

SYSTEM AND METHOD FOR IDENTIFYING VEHICLES AND COLLECTING FEES FOR VEHICLE USES OF LAND-WAYS, SEA-WAYS AND AIR-WAYS

CROSS-REFERENCE TO RELATED APPLICATIONS

This application is a Continue-in-Part of a U.S. patent application Ser. No. 09/635,624, which is incorporated by reference for all purpose in this application.

FIELD OF INVENTION

This patent relates to an identification (ID) and a surveillance system for vehicles of all types. This system facilitates identification, regulatory compliance and fee collection where appropriate for the ID-issuing authority. The system is intended to be international in scope and covers, as a minimum the United States, Canada and Mexico.

BACKGROUND OF THE INVENTION

A comprehensive national security system, identifying, tracking and monitoring all types of vehicles is needed in the light of the U.S. tragedy of 9/11. A faster, more convenient and more efficient toll-fee collections system is also in great demand.

Federal, state and local governmental agencies that maintain and regulate roadways, waterways and airway transportation have depended, in large measure, on the use of collected tolls and fees for proper maintenance and the construction of new infrastructures. The efforts to collect vehicle tolls have caused many problems, including:

1. In toll plazas, traffic back-ups have adverse effects to the environment, personal safety, and business enterprise.
2. Costs for labor and maintenance have diminished the profitability of the toll system.
3. Inasmuch as participation in transponder-fee-collection is voluntary, many people still rely on cash, extending the possibility of errors, mishandling of funds and failures in data collection and processing.

There are still significant problems in effective administration and oversight of vehicular regulatory compliance in the matters of insurance; vehicle safety inspection and vehicle exhaust system controls.

Transportation toll/fee collection systems have proved to be labor intensive and costly to construct and maintain. Under the current methods employed by authorized toll collection agencies, a motor vehicle operator must voluntarily subscribe to a transponder-type fee collection system, or queue-up to pay the required fee in cash. Utilization of the "cash-only" process necessitates a toll collector who must complete the collection which involves a time-consuming event adding to delays and traffic congestion and untoward accidents. Transponder-type fee collections have not been completely successful since a majority of motorists do not subscribe to this type of system. Furthermore, transponders may become defective under certain circumstances, and the unit itself may be stolen from the legitimate subscriber.

In many municipalities, the parking meter has served as a passive toll taker, but this method of fee collecting has not been fully successful. In the matter of parking meters, the motorist has often been unduly punished and the municipality cheated of revenue. False coins are put into meters and pilfering and destruction of coin boxes are serious problems with the unguarded equipment. Ill-prepared meter readers have often written inaccurate license numbers and street locations. Coin box theft and severe damage to meters caused by automobiles and vandals demand repairs and maintenance. Parking meter machines that print out time and date for paid vehicular parking are inefficient, demanding an inordinate number of coins, and requiring the meter reader to strain to see the correctness of the receipt placed on top of the vehicle's dashboard.

Police officers face several difficulties in current car-to-car surveillance work, checking dates of vehicle registration and certificates of inspection. Inclement weather can preclude the officer's attention to the routine surveillance; hastily written summons may incorrectly record vehicle license number, location and infraction.

SUMMARY OF THE INVENTION

A method for identifying and tracking vehicles is now herein described. This method uniquely identifies the vehicle by its vehicle identification number VIN ID in order to collect vehicle related fees and to monitor all vehicles for tracking and for other data such as vehicular regulatory compliance. The method includes:

(a) establishing a regional or international central data agency through treaties, to include all countries of the world and at a minimum the United States, Canada and Mexico;

(b) implanting a plurality of active and/or passive signaling VIN ID devices on every vehicle, including cars, boats and aircrafts, that operate or enter into the territory governed by the United States, Canada, Mexico or other participating countries;

(c) issuing a mandatory unique vehicle identification code for each vehicle by a central registration agency, said code associated with the vehicle's (VIN) ID Vehicle Identification Number and to include pertinent data about the registered owner/owners of said vehicle;

(d) scanning/reading said VIN ID code with associated signaling devices that send data to the central agency;

(e) inputting data concerning said vehicle to said central agency, said information including vehicle title, insurance, driver's license information, vehicle safety inspection, exhaust emissions control, and a chronology of accident reports;

(f) establishing an account for the said vehicle at said central agency, said account not requiring a subscription;

(g) providing vehicle identification code scanner/readers utilizing satellite scanners equipped with global positioning systems in the sky, and on the ground where scanners are positioned on transportation pathways;

(h) reading said vehicles' identification code (VIN ID) by said vehicle code reader/scanner each time said vehicle passes said scanner on the transportation pathway;

(i) communicating said vehicle's identification code (VIN ID) along with the date, time and geographical position to said central agency; and (j) using said (VIN ID) code to charge relevant fees against said account incurred by said vehicle for transportation pathways' usage by issuing a periodic report/billing of said account to the title owner of said vehicle containing identifications of date, time, place, fee charges and account balances.

Transportation pathways are defined to include all roadways, waterways, and airways used by any vehicle and regulated by the central agency.

The reader/scanner method may further include: equipping police traffic managers with hand-held code readers and equipping mobile vehicles with fixed-mounted code reader/scanners.

Fee schedules charged by the central agency will vary according to the type of each vehicle, taking into consideration essential factors including said vehicle's gross and tare weight and the verification of said vehicles' regulatory compliance relating to insurance, emissions, registration, title, and other safety and security matters.

BRIEF DESCRIPTION OF THE DRAWINGS

The features of the present method are better understood by description within this application and with reference to the accompanying drawings.

Figure 1:
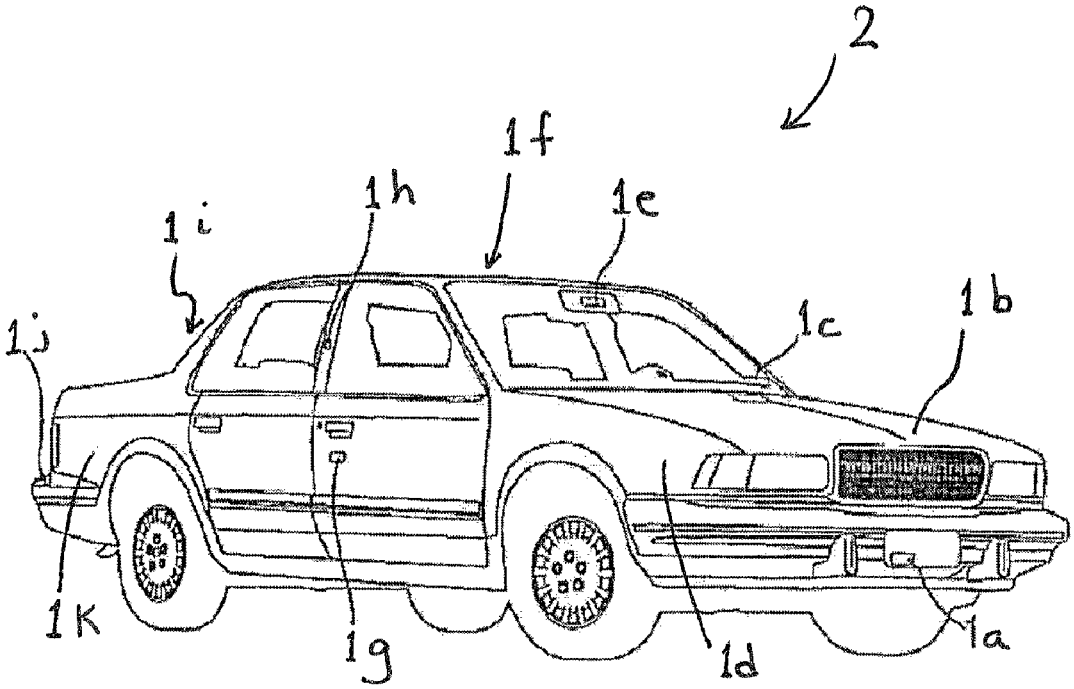
FIG. 1 is a roadway vehicle with attached or implanted VIN IDs. The VIN Codes are provided by the central agency or the motor vehicle registration office.
Figure 2A:
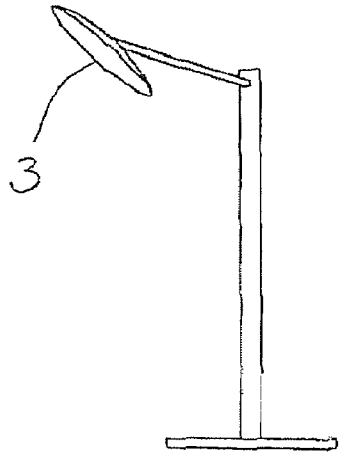
FIG. 2A is a model of a road-side, standing scanner that may be mobile or fixed and aligned at desired locations to identify vehicle's utilization of bridges, tunnels, highways and city streets.
Figure 2B:
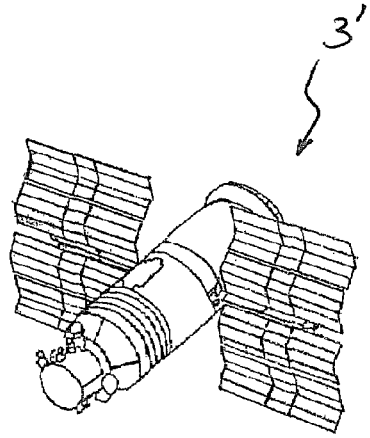
FIG. 2B is a Satellite scanner strategically located in the sky.
Figure 2C:
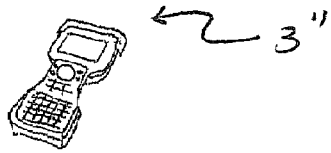
FIG. 2C is a hand-held scanner/reader.

The VIN ID codes are implanted or aligned in multiple locations on the vehicle, to be designated by the appropriate authorities.

DETAILED DESCRIPTION OF THE INVENTION

The invention relates to a system of identifying and tracking all vehicles and a method of collecting usage fees associated with all vehicles for their utilization of any roadway, waterway and/or airway and for monitoring all vehicular regulatory compliance wherein every vehicle contains its own unique identification code-similar or in concert with the known vehicle identification number (VIN) comprised of a number, letter or symbol or combinations thereof.

Roadway commercial vehicles and non-commercial vehicles are uniquely identified and monitored by scanner/readers at significant entries into the roadway and/or by satellite scanner/readers as said vehicles enter into and are tracked on United States' territorial roadways for safeguarding national security and/or for toll collection. Scanner/readers detect vehicles entering all strategically selected roadways and parking lots to allow the principality to monitor the regulation of safety and security compliance of said vehicles and to collect proper fees for road and parking uses.

Strategic use of this invention—Example #1: in New York City the administration has been considering installing a toll-fee system to charge for entry into Manhattan across the four free-passage East River bridges and an extra road use fee for vehicles to enter Manhattan's over-congested inner city, much as London and Singapore have installed to lessen congestion and reduce pollution. However, unlike London and Singapore, New York City will not have to condemn property and spend billions to construct toll booths with the installation of the instant invention.

Waterway commercial vehicles and non-commercial vehicles are uniquely identified and tracked by scanner/readers at selected shore lines and/or by satellite scanner/readers as said vehicle enters territorial waters for national security and/or for toll collection. Scanner/readers detect and track vehicles entering into waterways, harbors, marinas and as said vehicle passes under lift-bridges. Said vehicles are charged for waterway uses to allow the principality to build and maintain docks, locks, bridges and lift-bridges and provide staff services.

Aircraft commercial and non-commercial vehicles are uniquely identified and tracked upon entering the United States' territorial airspace by satellite scanner/readers as well as by strategically located airport scanner/readers. Satellite and land scanner/readers can also be strategically positioned for aircraft anti-drug enforcement as well as for national security. Fees and tolls are charged for airway uses to underwrite costs of service personnel as well as to make safety improvements in airport landing facilities.

Strategic use of this invention—Example #2: The National Transportation Safety Board (NTSB) reports that restriction on a $550 million system to prevent airport runway collisions has failed because of the air-controller's inability to track and clear moving service vehicles on the tarmac undermining the airport runway safety system. According to the Board, this represents the greatest threat in aviation, with the potential for a plane to strike one of these ground vehicles that crowd the runways. The Board reports that collisions between vehicles and planes were narrowly averted 26 times from 2003 to January 2007, according to USA Today, dated Apr. 6, 2007, reviewing Federal Aviation Administration (FAA) data. The instant system and method for identification and tracking vehicles will allow inexpensive, easy and effective tracking and management of all airport vehicles and prevent collisions.

Using earth fixed and mobile scanning/reading devices, as well as sky-satellite scanner/readers, this invention aims to construct a new and unique method for identifying, tracking and monitoring the locations of registered vehicles and collecting usage fees. These scanning/reading devices are compatible with the vehicles' signal-transmitting devices in terms of hardware and software. The data collected is used for monitoring and tracking, and for assessing and collecting transportation-pathway-use fees from all registered vehicles regardless of the country or state that issued that vehicle's registration.

Each scanner/reader identifies the presence of a vehicle even if the vehicle does not have a VIN ID signaling device. Thus, vehicles with no VIN ID code signal will set off Ground Positioning Scanner (GPS) alerts which are transmitted to police, land, sea and air interception units.

Vehicle VIN ID code scanner/readers (fixed or mobile) transfer data to a central agency, or other appropriate authorities and are placed in selected areas such as the entrances and exits of specified bridges, tunnels, highways, or waterways and airways. Participating authorized agents can use hand-held, or mounted vehicle-code-scanner/readers to monitor traffic, to charge a fee for legal overnight parking, illegal double parking or illegal standing, by identifying the vehicle from its implanted VIN ID code.

The instant invention proposes a redesign of a fee-collection schedule that is more equitably assessed to owners of all registered vehicles according to body type, laden weight or capacity and whether registered in U.S. domestic or foreign countries. All operators of all vehicles that utilize transportation pathways must be registered in the personnel data banks of the authority that issues licenses for the United States, Canada and Mexico.

According to the invention, each vehicle is assigned a unique VIN ID account like a debit or credit card. As designated by the appropriate authorities according to a schematic of the said vehicle, the VIN ID's are implanted or aligned in multiple locations on said vehicle, in such a way that they may be easily scanned/read by the scanning/reading devices.

The full and correct functioning of all scanner/readers can be verified by monthly testing and where needed may be repaired only by appropriate personnel.

Figure 4:
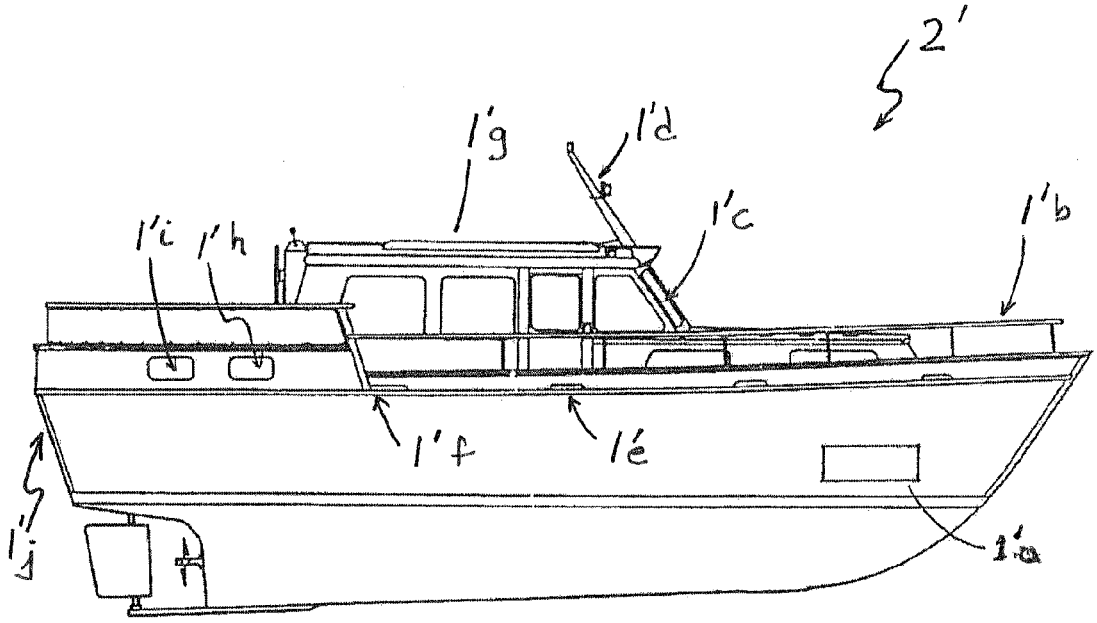
FIG. 4 is a waterway vehicle with attached or implanted VIN ID Codes provided by the marine vehicle registration office.
Figure 5:
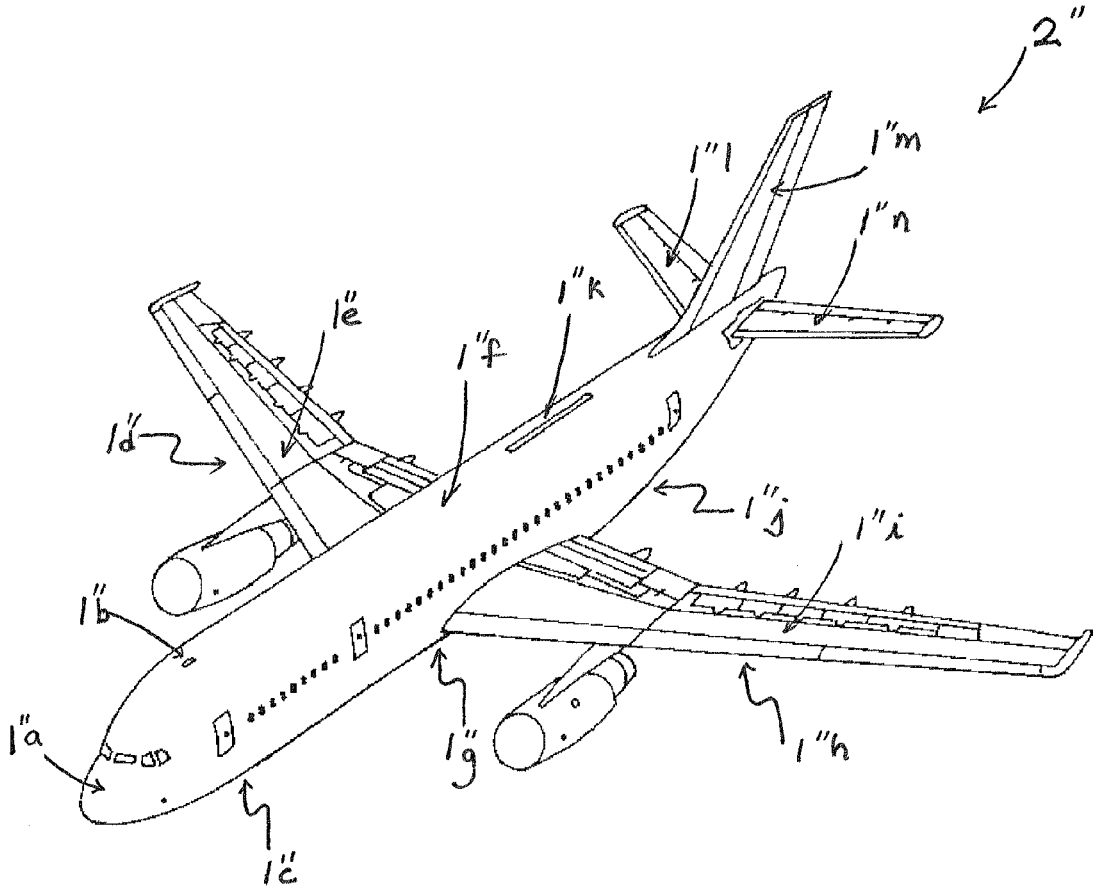
FIG. 5 is an airway vehicle with attached or implanted VIN ID codes provided by the aviation vehicle registration office.

A plurality—twelve or more—of the registered VIN ID code (1, 1' or 1") is applied to the body of said vehicle in multiple locations (2, 2' or 2"), as shown in FIGS. 1, 4, and 5. In FIG. 1, the different location for the registered VIN ID code is labeled 1*a* through 1*k*. In FIG. 4, the different locations for the registered VIN ID code is labeled 1′*a* through 1′*j*. In FIG. 5, the different locations for the registered VIN ID code is labeled 1″*a* through 1″*n*.

Unique information pertaining to any vehicle can be-easily captured and/or recorded by the capturing scanner/reader devices and relayed to the central data bank for processing, utilizing a scanner/reader (3, 3', 3", 3'''), as shown in FIG. 2A, FIG. 2B, FIG. 2C, or FIG. 3. The information capturing devices, whether hand-held, mobile or fixed, are strategically placed and monitored.

Figure 3:
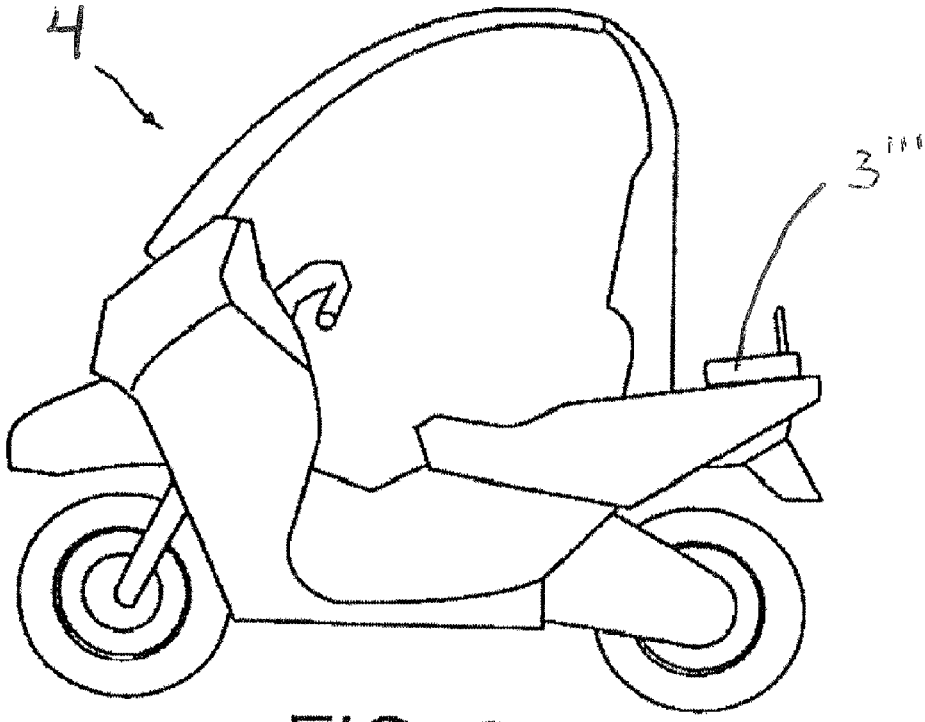
FIG. 3 is a scooter that is easily maneuverable in traffic, equipped with mounted scanner/readers, digital cameras or other VIN ID code information capturing devices.

FIG. 3 illustrates a scooter 4 equipped with fixed-mounted VIN ID code scanner/reader capturing equipment 3''' wherein the data captured by the scooter equipment is disseminated or communicated by known means to a central database.

A method for identifying and tracking vehicles and collecting vehicular data and assessing tolls and fees, and for monitoring vehicular regulatory compliance wherein a plurality of twelve or more of the same VIN ID code identifier is placed on and/or about a vehicle, said identifiers corresponding to a series of unique characteristics associated with the vehicle and one or more desired set of characteristics and/or data, wherein, each VIN ID may be identified for data retrieval and/or recording and/or storaging when positioned in proximity to a VIN ID code scanner/reader, where the VIN ID code scanner/reader may be aligned to track and/or trace a variety of information relative to the existence of one of more identifiers, wherein said VIN ID code scanner/reader includes the collection of desired data relative to the proximity of identifiers to identifier code scanner/readers.

In one embodiment, a method and system for collecting tolls and fees and for monitoring vehicular regulatory compliance, including a plurality of passive signaling devices aligned and applied to a vehicle so as to identify the tolls and fees charged against that unique vehicle, said signaling device to include the VIN ID a unique numeric or alpha numeric, or other unique identifying feature, or code, associated with the registered owner of the vehicle, said passive signaling devices positioned in desired proximity to record and monitor the use, said monitors comprising a mechanism capable of recording and/or otherwise documenting the existence, location proximity, frequency, duration, and/or other desired monitoring of events, from a desired position, the system of which results in the monitoring and processing of the data.

In such a system and method for collecting vehicle fees and for monitoring vehicular regulatory compliance, vehicles are aligned with passive, or active, or both active and passive readable identification VIN ID means to capture information while said vehicles are moving or still. The capturing means are aligned to track and to process the unique VIN ID code within a proximity and/or condition desired to be monitored. The collected information provides a mechanism to allow the charging of vehicle related tolls and fees.

One of the preferred VIN ID embodiments relates to a cost-effective method of collecting vehicular related fees using a passive identification system, such as a bar code, or the magnetic strip. The office that issues vehicle registration will issue the vehicle's unique VIN ID code and charge an appropriate amount to be held in an account against any and all road-usage charges and legal infractions associated with that vehicle's VIN ID.

A periodic report of road use containing exact identifications of time, place and fee charges can be sent to the title owner of the respective vehicle, and will note the account balance. If the title owner does not comply with the motor vehicle payment request, the standard delinquent response would follow, ultimately assessing increasing penalties to the title holder.

All new vehicle manufacturers will include factory-installed VIN ID codes in prescribed positions on the vehicle body.

In the above embodiments, conventional equipments for signaling, scanning, transmitting and processing the VIN ID code are used. The VIN ID code attached to the vehicle in multiple locations may be an active or passive unit, a transponder or an arrangement of bar codes or a Radio Frequency Identification (RFID) device, or a combination of any of these. Various scanner/readers may be used to read the identifiers: Type 1: Bar code scanner/readers; Type 2: Transmitter/receivers that send coded signals to and receive coded signals from the identifier transponder; Type 3: a receiver that reads the RFID'S radiating periodic identifying signals; Type 4: any combination of any of these, including satellite systems.

These scanner/readers and transmitter/receivers may be installed alongside any roadway or may be mobile as mounted in search-vehicles or hand-held, and can be included in one or more carrels which umbrella over any roadway. For water and air-going vehicles the system requires the installation of scanner-/readers in air control towers and along shorelines and near mouths of rivers, adjacent to bridges or ports of entry and will also include the utilization of satellite systems. All identifier signals are sent to a central data bank for processing.

In the present invention, if a bar code, transponder or RFID device is damaged or absent from one or more designated positions in the vehicle, an alerting system utilizing, lights, sounds, displays, etc. gives notice of any data-omission to the central data bank and can alert local police control systems in proximity. This alert is similar to the radar/computer display alerting systems utilized by air-traffic control display systems. The advantage of this system is the actual identification of the vehicle on a display which allows exact identification, geographical location and ranging of that vehicle.

When a vehicle is repaired by an approved and registered body shop after an accident involving vehicle-body damage, that accident must be reported to the central data bank and that vehicle must undergo re-examination certification to guarantee all bar codes, or transponders or RFID's are in correct position and operative on said vehicle. Each vehicle must be examined periodically by an approved and registered facility for connect VIN ID code operation for said vehicle.

The implementation of this invention may require international treaty cooperation. Bilateral or multilateral treaties may be entered for the execution of the system, such as implanting a plurality of passive and/or active signaling devices on every vehicle, including cars, boats and aircrafts, to be registered in the United States, Canada and Mexico. By establishing international conventions, the system may also include vehicles registered in foreign countries participating in regional or international treaties with the U.S.

The following definitions apply to the particular term used in this application:

A VEHICLE: For this patent a vehicle may be any mechanized conveyance that carries or transports one person, or people or goods from one place to another whether it travels across, through or in the mediums of land, water, or air.

A PATHWAY: For this patent, a road is any pathway for a vehicle, whether it is solidly fixed as one on land or as fluidly amorphous as one on sea or in the air. It can be broadly unrestrictive as the surface of a lake, river or the open sea; or a field of snow or ice; or the open expanse of air; or, contrarily, it can be as solidly-earthbound as a one-lane or multi-lane prepared pathway, open and unobstructed, to allow the passage of a vehicle moving on two or more wheels to pass over the surface of that pathway. It may also include lift-bridges that must be raised or swung open for a boat to pass.

I claim:

1. A method for identifying and tracking vehicles and collecting vehicle related tolls and fees and for monitoring vehicular regulatory compliance, comprising the steps of:

(a) establishing a regional or international treaty, including at least the United States, Canada and Mexico;

(b) implanting a plurality of active or passive signaling devices on every vehicle, to include cars, boats and aircrafts, that operate or enter into the territory governed by the United States, Canada or Mexico;

(c) issuing a mandatory unique vehicle identification code for each vehicle by a central registration agency, said code associated with at least the vehicle's vehicle identification number (VIN) and with a registered owner / or owners of said vehicle;

(d) associating said vehicle identification code with said signaling devices;

(e) inputting information concerning said vehicle to said central agency, said information including vehicle title, insurance, driver's license information, vehicle safety inspection, exhaust emissions control, and a chronology of accident reports;

(f) establishing an account at said central agency, said account not requiring a subscription;

(g) providing a vehicle identification code scanner or readers in satellite scanners equipped with global positioning systems in sky and on-ground scanners positioned on transportation pathways;

(h) reading said vehicle identification code with said vehicle code readers at periodic intervals when the vehicle is stationary and each time the vehicle passes the scanner on the transportation pathway;

(i) communicating said vehicle identification code with a date, a time and a vehicle geographical location to said central agency;

(j) using said vehicle identification code to charge relevant fees against said account incurred by said vehicle for transportation pathways' use during a period of time; and (k) issuing a periodic report of said account to the registered owner of the vehicle containing identifications of time, place, fee charges and account balances.

2. A method for collecting vehicle related fees and for monitoring vehicular regulatory compliance of claim 1, further comprising:

equipping traffic managers with mobile vehicle code readers.

3. A method for collecting vehicle related fees and for monitoring vehicular regulatory compliance of claim 1, further comprising:

said relevant fee may include additional fees according to the type of vehicle and vehicle weight.

4. A method for collecting vehicle related fees and for monitoring vehicular regulatory compliance of claim 1, further comprising:

using said code to monitor and verify vehicular regulatory compliance relating to insurance, emissions, registration and title matters; and issuing a periodic report to the title owner/owners of said vehicle containing regulatory compliance issues.

* * * * *